US010060134B2

(12) United States Patent
Stiglmayr et al.

(10) Patent No.: US 10,060,134 B2
(45) Date of Patent: Aug. 28, 2018

(54) DEVICE FOR TERMINATING A BOTTOM SECTION HAVING A SLAB OR STONE CLADDING

(71) Applicant: ST-PROFILE GMBH, Traun (AT)

(72) Inventors: Sandro Stiglmayr, Leonding (AT); Remo Walter Bacchetta, Horw (CH)

(73) Assignee: ST-Profile GmbH, Traun (AT)

( * ) Notice: Subject to any disclaimer, the term of this patent is extended or adjusted under 35 U.S.C. 154(b) by 0 days.

(21) Appl. No.: 15/559,387

(22) PCT Filed: Mar. 16, 2016

(86) PCT No.: PCT/AT2016/050063
§ 371 (c)(1),
(2) Date: Sep. 18, 2017

(87) PCT Pub. No.: WO2016/145469
PCT Pub. Date: Sep. 22, 2016

(65) Prior Publication Data

US 2018/0066436 A1 Mar. 8, 2018

(30) Foreign Application Priority Data

Mar. 17, 2015 (AT) ..... A 50215/2015

(51) Int. Cl.
*E04D 13/15* (2006.01)
*E04D 13/04* (2006.01)

(52) U.S. Cl.
CPC ..... *E04D 13/0459* (2013.01); *E04D 13/15* (2013.01)

(58) Field of Classification Search
USPC ..... 52/169.5, 61, 62
See application file for complete search history.

(56) References Cited

U.S. PATENT DOCUMENTS 1,327,770 A * 1/1920 Norton ..... E04D 13/15 52/96
3,415,020 A * 12/1968 Windle ..... E04D 13/15 52/300

(Continued)

FOREIGN PATENT DOCUMENTS

DE 90 07 152 U1 9/1990
DE 44 22 471 A1 1/1995

(Continued)

OTHER PUBLICATIONS

Espacenet. English Language Abstract of DE 20 2004 003286 U1. Schlueter Systems, KG, May 13, 2004.

(Continued)

*Primary Examiner* — Paola Agudelo
(74) *Attorney, Agent, or Firm* — Tiajoloff & Kelly LLP

(57) ABSTRACT

An apparatus is described for terminating a floor section (2) having a slab or stone paving (3) comprising a fastening leg (1) running parallel to the floor and a terminating leg (6) which protrudes from this fastening leg (1) and which is bent backwards in a fold-like manner at its end (9) opposite the fastening leg (1) and comprising a U-shaped plug-on profile (10) which can be plugged onto this terminating leg (6). In order to enable fairly large quantities of water to flow off easily, it is proposed that a web (7) which slopes down from the fastening leg (1) and forms a channel jointly with the terminating leg (6) is arranged between the fastening leg (1) and the terminating leg (6).

19 Claims, 1 Drawing Sheet

(56) References Cited

U.S. PATENT DOCUMENTS 3,735,540 A * 5/1973 Thaler ..... E04D 13/155 52/94
4,483,112 A * 11/1984 Rueblinger ..... E04D 13/155 52/58
4,665,667 A * 5/1987 Taylor ..... E04D 13/155 52/96
4,800,689 A * 1/1989 Lane ..... E04D 13/155 52/60
4,964,248 A * 10/1990 Braine ..... E04D 3/405 52/300
5,251,411 A * 10/1993 Kelley ..... E04D 13/064 156/290
5,272,846 A * 12/1993 Kelley ..... E04D 13/064 52/300
5,414,965 A 5/1995 Kelley et al.
5,979,123 A * 11/1999 Brockman ..... A01M 1/24 49/58
6,470,638 B1 * 10/2002 Larson ..... E04B 1/765 52/254
6,725,617 B2 * 4/2004 Cox ..... E04B 5/10 52/302.6
7,451,572 B1 * 11/2008 Inzeo ..... E04D 3/405 52/300
7,546,719 B1 * 6/2009 Guevara ..... E04F 13/06 52/302.6
8,739,470 B1 * 6/2014 Wayne ..... E04D 13/15 52/58
8,869,466 B2 * 10/2014 Garcia ..... E04D 13/15 52/60

FOREIGN PATENT DOCUMENTS

| | | | |
|---|---|---|---|
| DE | 198 21 785 | A1 | 4/1999 |
| DE | 20 2004 003286 | U1 | 5/2004 |
| DE | 20 2007 011416 | U1 | 1/2009 |
| EP | 0 882 856 | A2 | 12/1998 |
| EP | 2025827 | A1 | 2/2009 |
| GB | 1083213 | | 9/1967 |
| GB | 1104027 | | 2/1968 |
| GB | 2266106 | | 10/1993 |

OTHER PUBLICATIONS

Espacenet. English Language Abstract of DE 44 22 471. Werner Nill, Jan. 12, 1995.
Espacenet. English Language Abstract of De 198 21 785 (A1), Adolf Beaumjohann et al., Apr. 8, 1999.
Espacenet. English Language Abstract of EP 0882856 (A2), Walter Gutjahr, Dec. 9, 1998.
Espacenet. English Language Abstract of EP 2025827 (A1), Walter Gutjahr, Feb. 18, 2009.

* cited by examiner

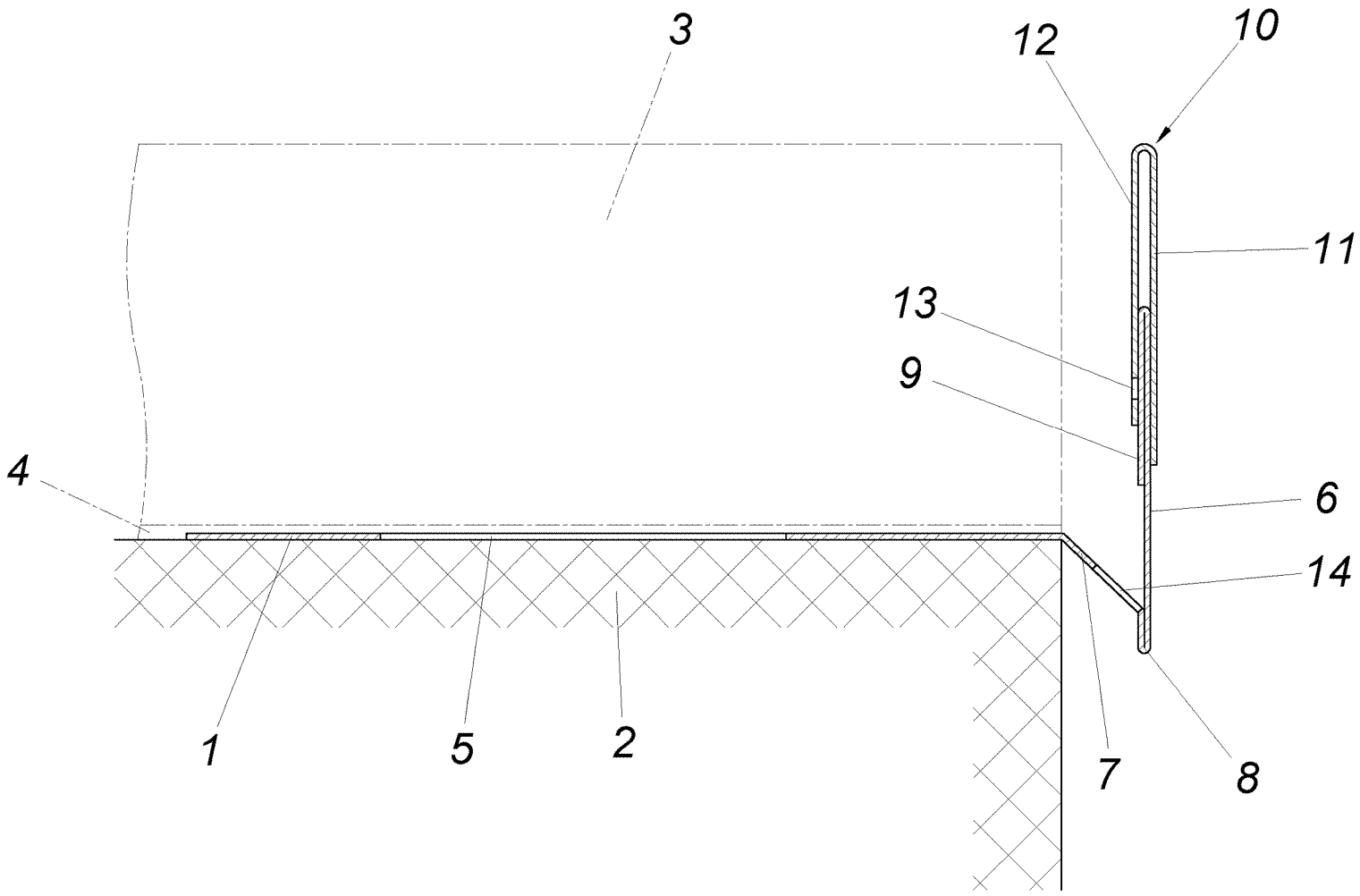
10
11
6
14
8
7
12
13
9
3
2
5
1
4

DEVICE FOR TERMINATING A BOTTOM SECTION HAVING A SLAB OR STONE CLADDING

1. FIELD OF THE INVENTION

An apparatus is described for terminating a floor section having a slab or stone paving comprising a fastening leg running parallel to the floor and a terminating leg which protrudes from this fastening leg and which is bent backwards in a fold-like manner at its end opposite the fastening leg and comprising a U-shaped plug-on profile which can be plugged onto this terminating leg.

2. DESCRIPTION OF THE PRIOR ART

In order to terminate a slab-covered balcony, it is known (DE 202004003286 U1) to provide an apparatus comprising a fastening leg arranged under the slab paving and a terminating leg projecting from this, which delimits the slab covering of the balcony. The terminating leg has an end section bent backwards in a fold-like manner at its end opposite the fastening leg, on which a U-shaped plug-on profile can be plugged which forms a cover for the floor slab. A disadvantage however is that water collecting on the slab paving can only flow off to an insufficient extent.

SUMMARY OF THE INVENTION

It is therefore the object of the invention to configure an apparatus for terminating a floor section having a slab or stone paving of the type described initially so that even larger quantities of water can flow off easily.

The invention solves the formulated object whereby a web which slopes down from the fastening leg and forms a channel jointly with the terminating leg is arranged between the fastening leg and the terminating leg.

As a result of these measures, water flowing from slab or stone paving can collect in the channel formed between the web and the terminating leg and drain via a drain provided for this purpose. This reduces the risk of water flowing directly onto any concrete or masonry forming the forming the base for the ground and the slab or stone paving lying thereon.

In order to ensure that in the case of thicker slabs or stone pavings, or in the case of different height levels of the slab or stone paving or of the ground, the water flowing from the slab or stone paving is collected in the channel according to the invention, the U-shaped plug-on profile for the terminating leg can be plugged onto the terminating leg variously far over the longitudinal profile of the apparatus, whereby the plug-on profile with its two U-shaped legs embraces the end of the terminating profile bent backwards in a fold-like manner resiliently and under pre-stress. This is in particular advantageous when the base for fastening legs and slab or stone paving is sloping as is the case with terraces or balconies in order to facilitate the draining of water because in this case the slab or stone paving is laid horizontally without any inclination and the plug-on profile can be adapted to the level of the slab or stone paving by plugging onto the terminating leg variously far. In order to facilitate the plugging of the plug-on profile onto the terminating leg, one leg of the plug-on profile can be configured to be longer than the other so that the plug-on profile is placed onto the terminating leg with its longer leg, the two legs of the U-shaped plug-on profile can be opened against the spring force and the plug-on profile can be plugged onto the terminating leg. In order to fasten the plug-on profile on the terminating leg, in addition to the resilient configuration of the two legs of the U-shaped plug-on profile, at least one leg of the plug-on profile can be provided with fastening openings. This is particularly advantageous when the plug-on profile is plugged variously far over the longitudinal profile of the terminating leg in order to compensate for a height difference as described above. The fastening openings enable a simple gluing, soldering or welding of the plug-on profile with the terminating leg and specifically in the position required for the height level compensation.

The terminating leg can have drain openings at the height of the web for example as a drain for the draining water. These drain openings can fundamentally have any shape but advantageous drainage conditions are obtained if the drain openings are a plurality of rectangular openings spaced apart from one another in the longitudinal direction of the terminating leg which sit with their lower edge at the lowest point of the channel formed by the web and the terminating leg.

In addition to or alternatively to the drain openings in the terminating leg, the web can also have drain openings. These can advantageously be arranged in the lower region of the web adjoining the terminating leg. Advantageous drainage conditions are also obtained here if the drain openings are a plurality of rectangular openings spaced apart from one another in the longitudinal direction of the web which sit with their lower edge at the lowest point of the channel formed by the web and the terminating leg. Drain openings provided only in the web additionally have the advantage that drain openings in the terminating leg can be avoided and thus a visually attractive termination of the base with slab or stone paving is obtained.

As a result of a corresponding dimensioning of the web with regard to its length and its angle of inclination, the drain openings can be spaced so far apart from any concrete or masonry that even with larger quantities of water, draining of water via the concrete or masonry is prevented. This risk can be further reduced by lengthening the terminating leg in the transition region to the web downwards in a fold-like manner to a drip edge. As a result of this measure, the water draining off via the slab or stone paving initially runs into the channel formed by the web and the terminating leg and collects there. If drain openings are provided in the terminating leg, the water then flows via the drain openings onto the outer side of the terminating leg from where it can run off or drip over the drip edge on the outer side of the terminating leg. If the drain openings are arranged in the web, the water flows through the openings in the web onto its lower outer side and then as a result of the adhesion also flows off via the drip edge on the inner side of the terminating leg.

BRIEF DESCRIPTION OF THE DRAWING

The drawing shows the subject matter of the invention for example and specifically in a schematic cross-section.

DESCRIPTION OF THE PREFERRED EMBODIMENT

The apparatus according to the invention comprises a fastening leg 1 which runs between a base section 2 and a slab or stone paving 3 and is embedded for example in a bed 4 for the slab or stone paving 3. In order to allow a better connection between the bed 4 and the fastening leg 1, the fastening leg 1 can have openings 5. A terminating leg 6 projects from this fastening leg 1 which is connected to the fastening leg 1 via a web 7 forming a drip edge 8. The drip edge 8 is obtained from a fold formed from the web 7 and the terminating leg 6. The end 9 opposite the drip edge 8 is bent back in a fold-like manner. A U-shaped plug-on profile 10 is formed on the terminating leg 6 which has a longer leg 11 and a shorter leg 12. For fastening the plug-on profile 10 on the terminating leg 6 the plug-on profile 10 can be provided with fastening openings 13.

In order to be able to collect and lead off water flowing from the slab or stone paving 3, the web 7 and the part of the terminating leg 6 adjoining the web 7 form a channel for the draining water. For this channel drain openings 14 are provided in the web 7 through which the water collected in the channel can flow off outwards and via the drip edge 8. These drain openings 14 are rectangular through openings in the web 7 which are distributed over its length and which end with their lower edge with the channel formed from the web 7 and the terminating leg 6. Naturally as explained above, other drain openings can also be provided.

The invention claimed is:

1. Apparatus for terminating a floor section having a slab or stone paving, said apparatus comprising:

a fastening leg running parallel to the floor section; and a terminating leg that protrudes from the fastening leg and that is bent backwards so as to form a fold structure at an upper end thereof opposite the fastening leg; and a U-shaped plug-on profile configured to be plugged onto the terminating leg over said fold structure;

wherein a web that slopes down from the fastening leg and forms a channel jointly with the terminating leg is arranged between the fastening leg and the terminating leg.

2. The apparatus according to claim 1, wherein the plug-on profile has at least one leg provided with fastening openings.

3. The apparatus according to claim 2, wherein the terminating leg has drain openings at a height of the web.

4. The apparatus according to claim 2, wherein the web has drain openings.

5. The apparatus according to claim 2, wherein, in a transition zone to the web, the terminating leg has a second fold structure extending downwards towards a drip edge.

6. The apparatus according to claim 1, wherein the terminating leg has drain openings at a height of the web.

7. The apparatus according to claim 6, wherein the web has drain openings.

8. The apparatus according to claim 6, wherein, in a transition zone to the web, the terminating leg has a second fold structure extending downwards towards a drip edge.

9. The apparatus according to claim 1, wherein the web has drain openings.

10. The apparatus according to claim 9, wherein, in a transition zone to the web, the terminating leg has a second fold structure extending downwards towards a drip edge.

11. The apparatus according to claim 1, wherein in a transition zone to the web the terminating leg has a second fold structure extending downwards towards a drip edge.

12. An apparatus for terminating a floor section having a slab or stone paving, said apparatus comprising:

a fastening leg running parallel to the floor section;

a web that slopes downwards and away from the fastening leg;

a terminating leg that is connected with the web and extends upward from a lower portion thereof;

said terminating leg having an upward end wherein the terminating leg is bent so as to have two portions extending adjacent each other in a fold structure; and a U-shaped plug-on profile plugged onto the upper end of the terminating leg over said fold structure;

wherein the web and the terminating leg define a channel therebetween.

13. The apparatus according to claim 12, wherein the U-shaped plug-on profile has two legs, each on a respective side of said upper portion, and at least one of said legs has fastening openings therein providing access to the upper portion therethrough.

14. The apparatus according to claim 13, wherein the terminating leg has a second fold structure adjacent and extending downwards from the web, said fold structure providing a drip edge below said web.

15. The apparatus according to claim 12, wherein the terminating leg has drain openings at a height of the web allowing fluid in the channel to pas therethrough.

16. The apparatus according to claim 15, wherein the terminating leg has a second fold structure adjacent and extending downwards from the web, said fold structure providing a drip edge below said web.

17. The apparatus according to claim 12, wherein the web has drain openings therein allowing fluid in the channel to pas therethrough.

18. The apparatus according to claim 17, wherein the terminating leg has a second fold structure adjacent and extending downwards from the web, said fold structure providing a drip edge below said web.

19. The apparatus according to claim 12, wherein the terminating leg has a second fold structure adjacent and extending downwards from the web, said fold structure providing a drip edge below said web.

* * * * *